US007461833B1

(12) United States Patent
Gibbs

(10) Patent No.: US 7,461,833 B1
(45) Date of Patent: Dec. 9, 2008

(54) PICKET ASSEMBLY FOR A POST

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 0 days.

(21) Appl. No.: 11/668,942

(22) Filed: Jan. 30, 2007

(51) Int. Cl.
*E04H 17/14* (2006.01)

(52) U.S. Cl. ..... 256/22; 256/11

(58) Field of Classification Search ..... 256/1, 256/11, 12, 22, 65.11, 65.12; 52/101, 301
See application file for complete search history.

(56) References Cited

U.S. PATENT DOCUMENTS

| | | | | | |
|---|---|---|---|---|---|
| 814,984 | A | * | 3/1906 | Palmer | 256/11 |
| 1,902,511 | A | * | 3/1933 | McDaniel | 40/607.12 |
| 1,980,852 | A | * | 11/1934 | Dandliker | 256/11 |
| 2,199,518 | A | * | 5/1940 | Coleman | 256/35 |
| D133,482 | S | | 8/1942 | MacKenzie | |
| 2,306,080 | A | * | 12/1942 | Peles | 52/101 |
| D162,275 | S | | 2/1951 | Youngworth | |
| D166,382 | S | | 4/1952 | Falatico | |
| 3,218,036 | A | * | 11/1965 | Kozub | 256/22 |
| 3,282,000 | A | * | 11/1966 | Shaw et al. | 52/101 |
| 3,315,943 | A | * | 4/1967 | Den Broek | 256/22 |
| 3,892,387 | A | | 7/1975 | Mann | |
| 3,935,655 | A | * | 2/1976 | Fritzinger | 40/607.11 |
| 3,972,510 | A | * | 8/1976 | Dougherty | 256/11 |
| D245,870 | S | * | 9/1977 | Dougherty | D25/135 |
| 4,074,893 | A | | 2/1978 | Coltrin | |
| 4,602,765 | A | | 7/1986 | Loper et al. | |
| 4,667,935 | A | * | 5/1987 | Moore | 256/22 |
| 4,723,759 | A | | 2/1988 | Patrick | |
| 5,136,813 | A | | 8/1992 | Gibbs et al. | |
| 5,272,838 | A | | 12/1993 | Gibbs | |
| 5,332,196 | A | * | 7/1994 | Wright | 256/47 |
| 5,345,723 | A | | 9/1994 | Gibbs | |
| 5,415,380 | A | | 5/1995 | Sharp | |
| 5,433,029 | A | * | 7/1995 | Donoho et al. | 43/1 |

(Continued)

OTHER PUBLICATIONS

Ameristar Fence Products, Inc., "Aegis II Ornamental Fence & TransPort Ornamental Gates," pp. 1-16, published in the United States in Aug. 1999.

(Continued)

*Primary Examiner*—Daniel P Stodola
*Assistant Examiner*—Joshua T Kennedy
(74) *Attorney, Agent, or Firm*—Gary Peterson

(57) ABSTRACT

A picket assembly adapted for installation on a post of a barrier, such as a corner post. The picket assembly comprises at least one post picket having an upper portion and a lower portion. The lower portion of each post picket is characterized by a rectilinear profile. The picket assembly further comprises a post closure, which is formed from a cap and a bracket. The cap is adapted to fit around the upper end of the post and is provided with recesses sized to clearingly receive the lower portion of a post picket therethrough. The recess are provided in a number equalling the number of post pickets. The bracket of the post closure extends from the lower surface of the cap can be received within the open upper end of the post. The bracket provides an attachment surface that bracingly engages the lower portion of each post picket when that post picket is received through a recess of the cap.

30 Claims, 6 Drawing Sheets

U.S. PATENT DOCUMENTS

| | | | | |
|---|---|---|---|---|
| 5,443,244 | A | 8/1995 | Gibbs | |
| 5,613,664 | A | 3/1997 | Svalbe | |
| 6,076,807 | A * | 6/2000 | Spence | 256/1 |
| 6,176,043 | B1 | 1/2001 | Gibbs | |
| 6,254,064 | B1 | 7/2001 | Gibbs | |
| 6,264,173 | B1 * | 7/2001 | Badger et al. | 256/10 |
| D465,856 | S | 11/2002 | Givens et al. | |
| D466,620 | S | 12/2002 | Givens et al. | |
| D467,669 | S | 12/2002 | Givens et al. | |
| D468,028 | S | 12/2002 | Givens et al. | |
| D479,883 | S | 9/2003 | Gresham et al. | |
| 6,811,145 | B2 | 11/2004 | Gibbs et al. | |
| 6,836,992 | B2 * | 1/2005 | Rains | 43/1 |
| 6,848,677 | B2 | 2/2005 | Cantley | |
| 6,874,767 | B1 | 4/2005 | Gibbs | |
| 6,880,811 | B2 * | 4/2005 | Burdick | 256/10 |
| 6,969,051 | B1 | 11/2005 | Gibbs | |
| D566,292 | S | 4/2008 | Gibbs | |
| 2003/0122115 | A1 * | 7/2003 | Ernst et al. | 256/1 |
| 2007/0271859 | A1 * | 11/2007 | Scheirs | 52/101 |

OTHER PUBLICATIONS

Ameristar Fence Products, Inc., "Aegis II Industrial & Aegis Plus Commercial Ornamental Steel Fence and TransPort Ornamental Gates," pp. 1-18, published in the United States in Aug. 2000.

Ameristar Fence Products, Inc., "Aegis Ornamental Steel Residential Fencing," pp. 1-8, published in the United States no longer than Apr. 2001.

Ameristar Fence Products, Inc., "2002 Price Catalog," all pages, published in the United States by at least Nov. 1, 2001 (prices redacted).

Ameristar Fence Products, Inc., "Tired of the Threats?," pp. 1-12, published in the United States in Aug. 2002.

* cited by examiner

PICKET ASSEMBLY FOR A POST

BACKGROUND OF THE INVENTION

The present invention relates generally to barriers, and more particularly to a picket assembly for the post of a fence.

BRIEF SUMMARY OF THE INVENTION

The present invention comprises a picket assembly adapted for installation on a post of a barrier. The picket assembly comprises at least one post picket having an upper portion and a lower portion. The lower portion of each post picket is characterized by a rectilinear profile. The picket assembly further comprises a post closure, which is formed from a cap and a bracket. The cap is adapted to fit around the upper end of the post and is characterized by at least one recess formed therein. The number of recesses provided in the cap should equal the number of post pickets. Each recess is sized to clearingly receive the lower portion of a post picket therethrough. The bracket of the post closure extends from the lower surface of the cap and is sized to be clearingly received within the open upper end of the post. The bracket provides an attachment surface adapted to bracingly engage the lower portion of each post picket when that post picket is received through a recess of the cap.

The present invention further comprises a kit formed from a post closure, as described above, and at least one post picket, as described above.

BRIEF DESCRIPTION OF THE DRAWINGS

FIG. 5 is a bottom plan view of the picket assembly shown in FIG. 3, taken along line 5-5.

DETAILED DESCRIPTION OF THE INVENTION

Figure 1:
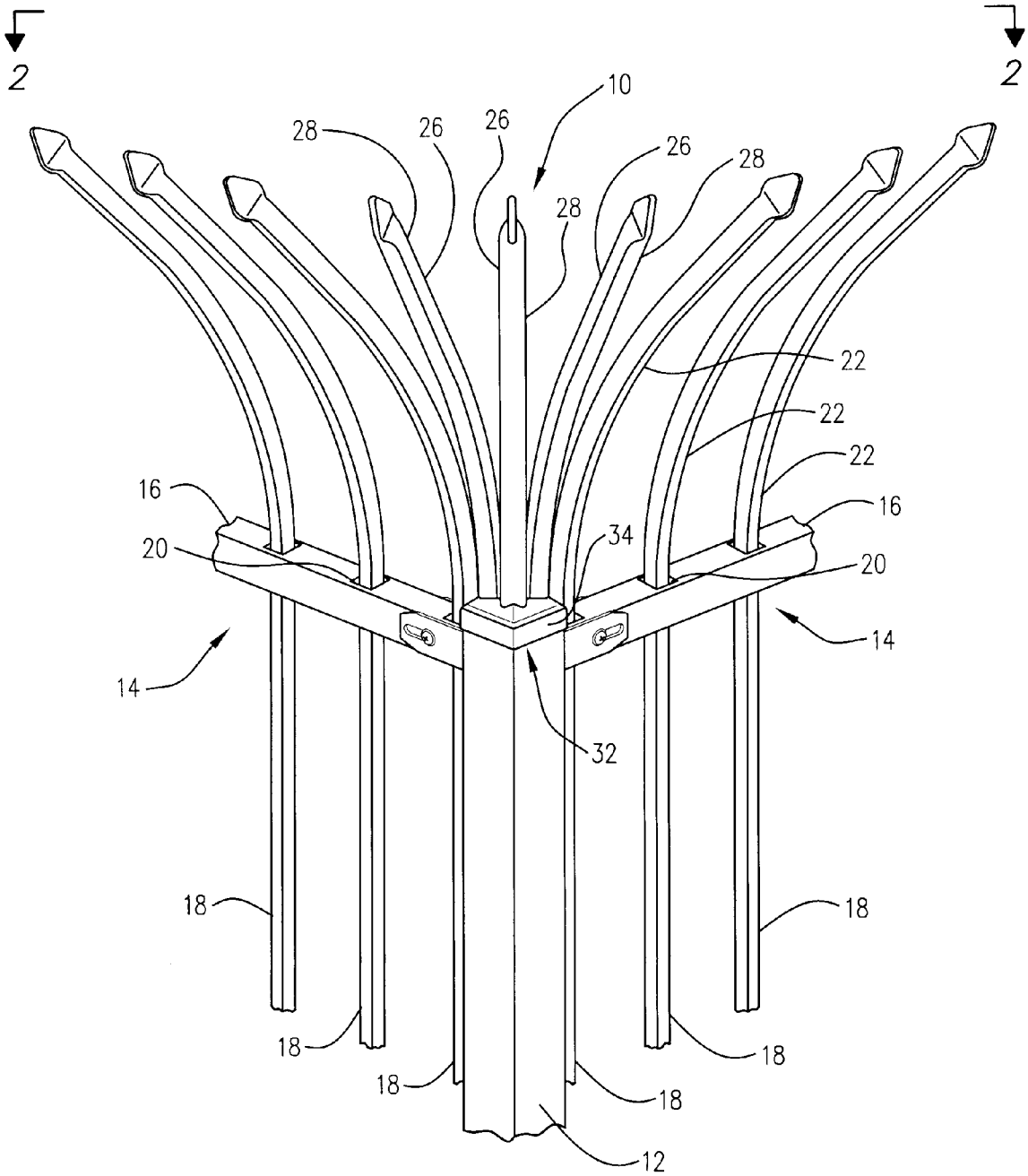
FIG. 1 is a front perspective view showing the picket assembly of the present invention, in an installed configuration on the corner post of a fence.

With reference to FIGS. 1-4, the present invention comprises a picket assembly 10 adapted for installation on a post of a barrier 14, such as a fence. The barrier 14 comprises a plurality of posts (of which only the corner post 12 is shown) preferably identical in construction, each of which is securely anchored at its base within a substrate (not shown), such as an underground mass of concrete. Each post extend along a rectilinear longitudinal axis, is tubular in construction, and is characterized by an open upper end, which is preferably closed by a cap. Preferably, each post is characterized by a rectangular transverse cross-section.

The posts are situated along the boundary of the area to be enclosed by the barrier 14, with a post spacing which is adequate to impart strength to the barrier 14 and to securely anchor other fence components. In one preferred embodiment, adjacent posts are separated by a distance no greater than 8 feet. The posts may be arranged in side-by-side relationship along two or more straight lines, two of which converge at a vertex, at which the corner post 12 is situated.

The barrier 14 further comprises a plurality of longitudinal rails 16, preferably of identical construction, which extend in transverse relationship to the posts. Each of the rails 16 extends between each adjacent pair of posts, including the corner post 12 and each of its adjacent line posts, and is supported by the posts at its opposite ends. The rails 16 are preferably configured into a rail assembly, such that at least two, and preferably three or more rails 16 extend between each adjacent pair of posts. The length of each rail 16 should be sufficient to fully span the distance between the adjacent of pair of posts 12 which will support that rail 16.

The rails 16 which extend between a given pair of posts are preferably disposed in parallel relationship. The incline of each rail 16 with respect to horizontal should substantially equal the incline of the terrain on which pair of posts supporting that rail 16 are installed. Thus, when the barrier 14 is positioned on horizontal terrain, the rails 16 will be disposed substantially horizontally.

Figure 2:
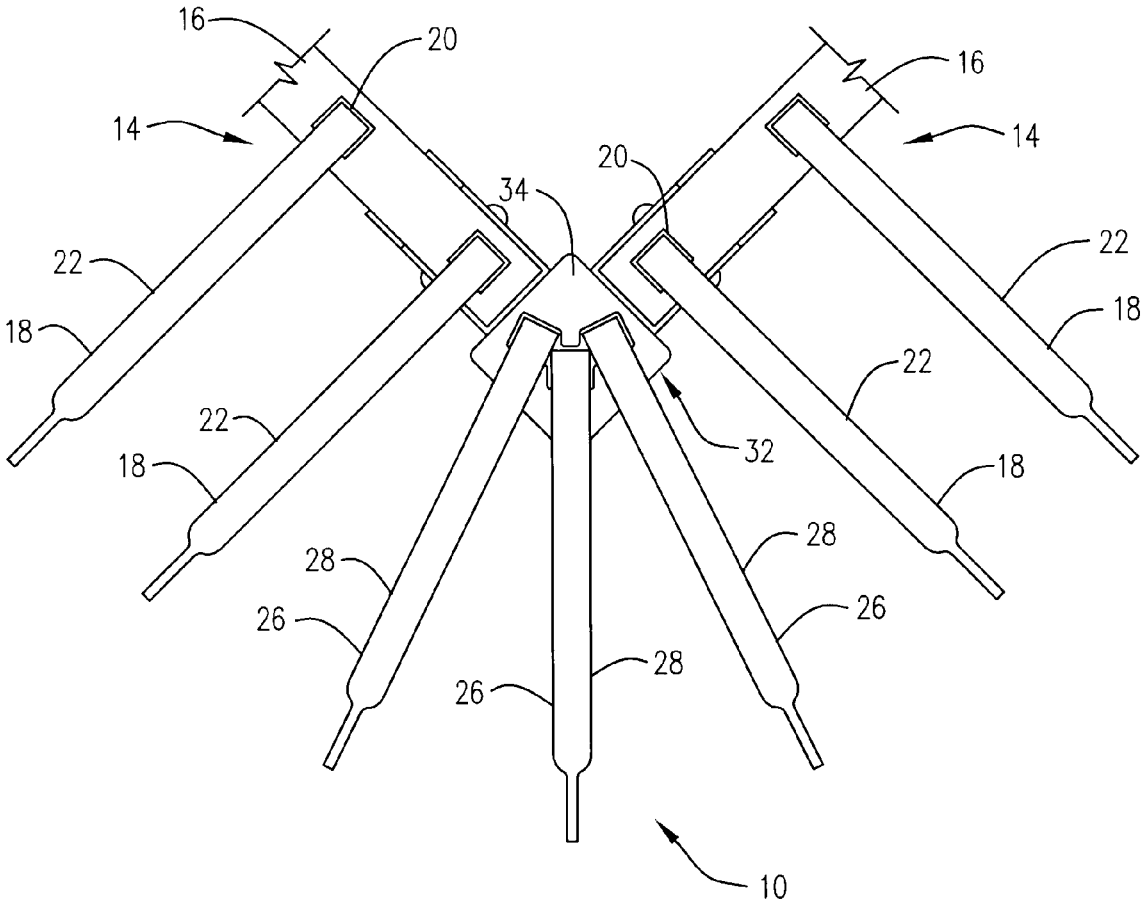
FIG. 2 is a top plan view of the picket assembly and fence shown in FIG. 1, taken along line 2-2.

With continued reference to FIGS. 1 and 2, the barrier 14 further comprises a plurality of elongate line pickets 18, preferably of identical construction, each of which extends in transverse relationship to the vertically spaced rails 16. Each line picket 18 is secured to each of the spaced rails 16. Preferably, the line picket 18 extends through an opening 20 formed in the upper surface of each rail 16, and is secured internally within the rail 16 by a retaining rod extending through the line picket, as described in U.S. Pat. No. 5,443,244. Alternately, the line picket may be secured externally to the rail 16 by a fastener, such as a bolt, or secured internally within the rail by welding. The base of each line picket 18 is preferably situated no more than a small distance above the terrain supporting the barrier 14, in order to prevent an intruder from traversing the gap between the base of the line picket 18 and the terrain.

The vertical height of each line picket 18 is preferably at least as great as the vertical height of the posts. The line pickets 18 are preferably oriented in parallel relationship, with a separation distance between adjacent line pickets 18, and between each post and its adjacent line picket 18, which is sufficiently small to prevent an intruder from traversing the gap. In one preferred embodiment, the separation distance between the centers of adjacent line pickets 18, and between each post and its adjacent line picket 18, is no more than 6 inches. Between adjacent pairs of posts, line pickets 18 should be provided in sufficient number to assure that the separation distance adjacent line pickets 18, or between a post and an adjacent line picket 18, does not exceed the requisite distance.

Each of the line pickets 18 is characterized an upper portion 22 and a rectilinear lower portion 24. In an installed position, the upper portion 22 of each line picket 18 is situated above the uppermost rail 16 of the barrier 14, while the lower portion 24 is situated between the uppermost and lowermost rails 16. Preferably, the upper portion 22 is characterized by curved profile, as shown in FIG. 1, with the curve extending toward the exterior of the barrier 14 and presenting a concave surface to the terrain. The projecting concave surface configuration of the upper portions 22 of the line picket 18 is well adapted to deterring an intruder attempting to climb over the barrier 14.

Further deterrence of climbing may be effected by forming the end of the upper portion 22 into a pointed or sharpened configuration, such as a spear or spike.

The components of the barrier 14, including posts, rails 16 and line pickets 18, are preferably formed from a strong and durable material, such as steel, and may be configured into the requisite shape by roll forming.

Figure 3:
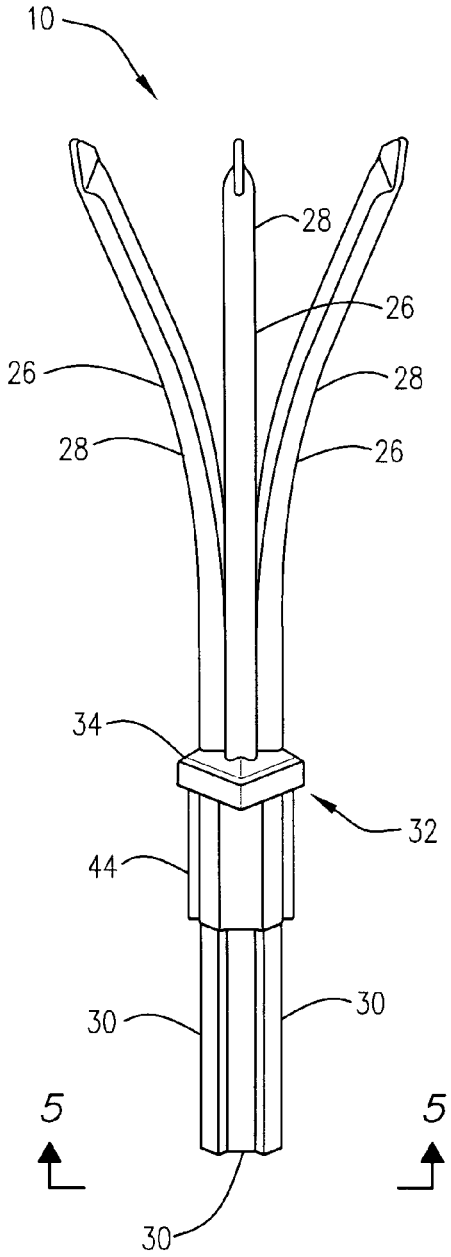
FIG. 3 is a front perspective view of the picket assembly of the present invention, in an assembled but uninstalled configuration.
Figure 4:
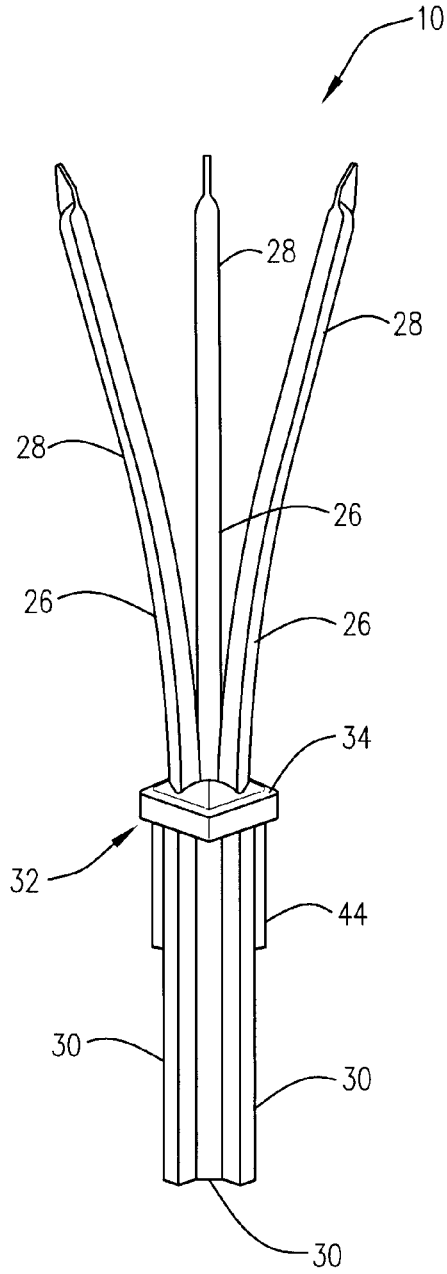
FIG. 4 is a rear perspective view of the picket assembly shown in FIG. 3.
Figure 3:
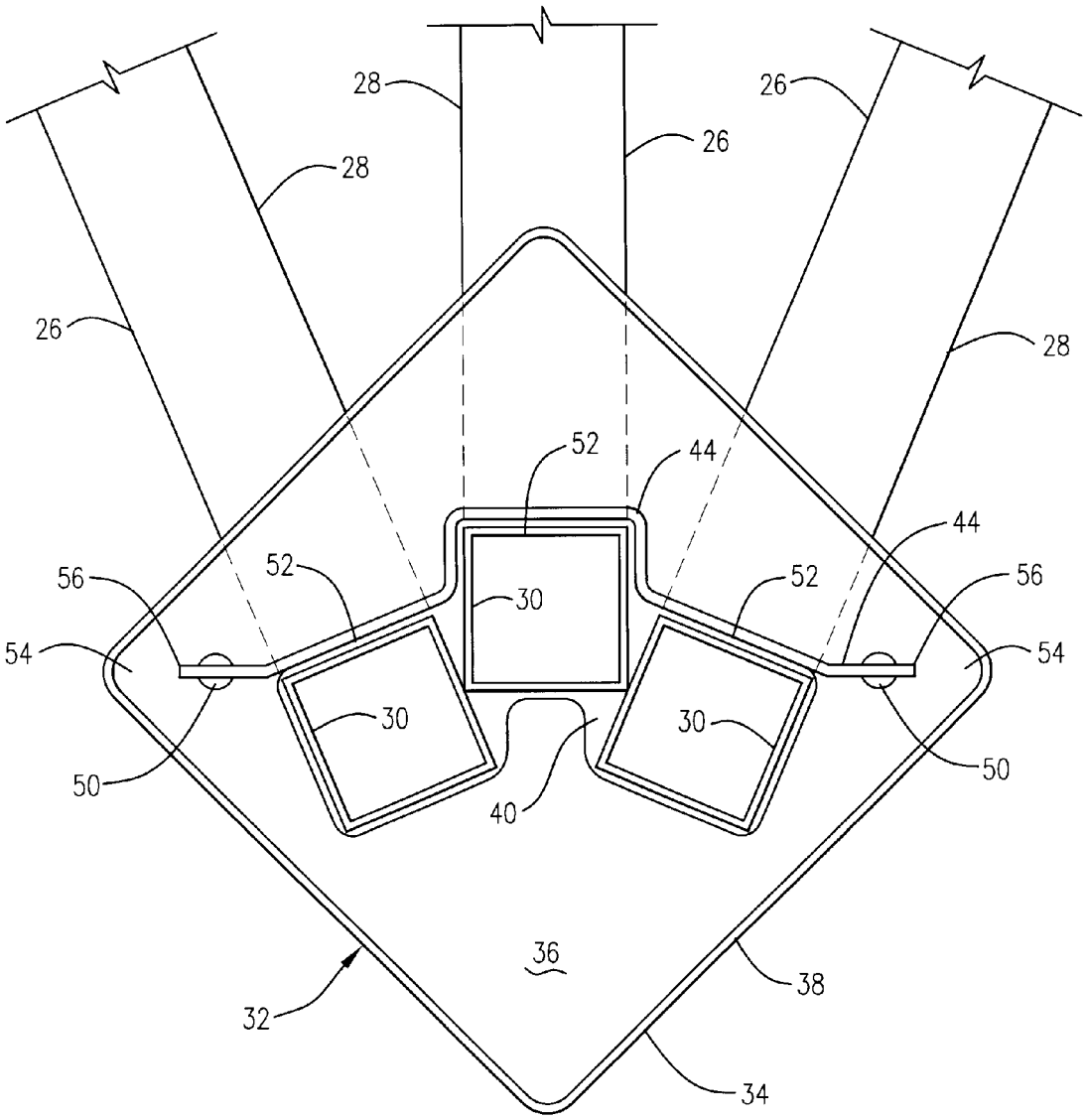

With reference to FIGS. 1-5, the picket assembly 10 comprises at least one post picket 26 having an upper portion 28 and a lower portion 30, with the lower portion 30 characterized by a rectilinear profile, as best shown in FIGS. 3 and 4. Preferably, the picket assembly 10 comprises at least two, and more preferably three post pickets 26. The post pickets 26 comprising the picket assembly 10 are preferably of identical shape and construction, and preferably are formed from the same materials as the line pickets 18. The upper portion 28 of each of the post pickets 26 is preferably characterized by a profile conforming to that of the upper portion 22 of the line pickets 18. In the embodiment shown in the Figures, the upper portion 28 of each post picket 26 is characterized by a curved profile. The lower portions 30 of the post pickets 26 are preferably characterized by a length substantially less than that of the lower portions 24 of the line pickets 18. An acceptable length for the lower portion 30 of is between about 6 inches and about 18 inches.

The picket assembly 10 further comprises a post closure 32 which functions to hold the post pickets 26 and close the hollow upper end of the corner post 12. Components of the post closure 32 are preferably formed from the same materials as the corner post 12 and line posts. The post closure 32 comprises a cap 34, best shown in FIGS. 6 and 7, having an inner surface 36 and an outer surface 38. The cap 34 is preferably identical in size and construction as the caps used on the line posts. The cap 34 is hollow and its base should have a transverse cross-sectional profile which matches that of the corner post 12, so that the cap 34 can closely fit around the upper end of the corner post 12, and thereby close it. One or more fastener openings (not shown) may be provided in the cap 34 in order to secure the cap 34 to the corner post 12. Alternatively, cap 34 may be secured to corner 12 post by welding or some other binding technique.

At least one, and preferably a plurality of recesses 40 are formed in the cap 34, in a number equal to the number of post pickets in the picket assembly 10. Thus, in the embodiment shown in the Figures, which features a picket assembly 10 formed from three post pickets 26, three recesses 40 are provided in the cap 34. Each recess 34 is sized to closely, but clearingly, receive the lower portion 30 of a post picket 26 therethrough, as shown in FIGS. 3 and 4.

When plural recesses 40 are provided, the recesses 40 are preferably joined into a unitary opening 42, as shown in FIG. 5. If such a joined opening 42 is provided, each individual recess 40 should retain a sufficient portion of its borders cap 34 with so that the recess 40 remains capable of guiding and positioning a post picket 26. Alternately separate discrete recesses may be provided. The recesses 40 (and opening 42, if any) are preferably formed with a punch after the cap 34 has been manufactured.

Figure 6:
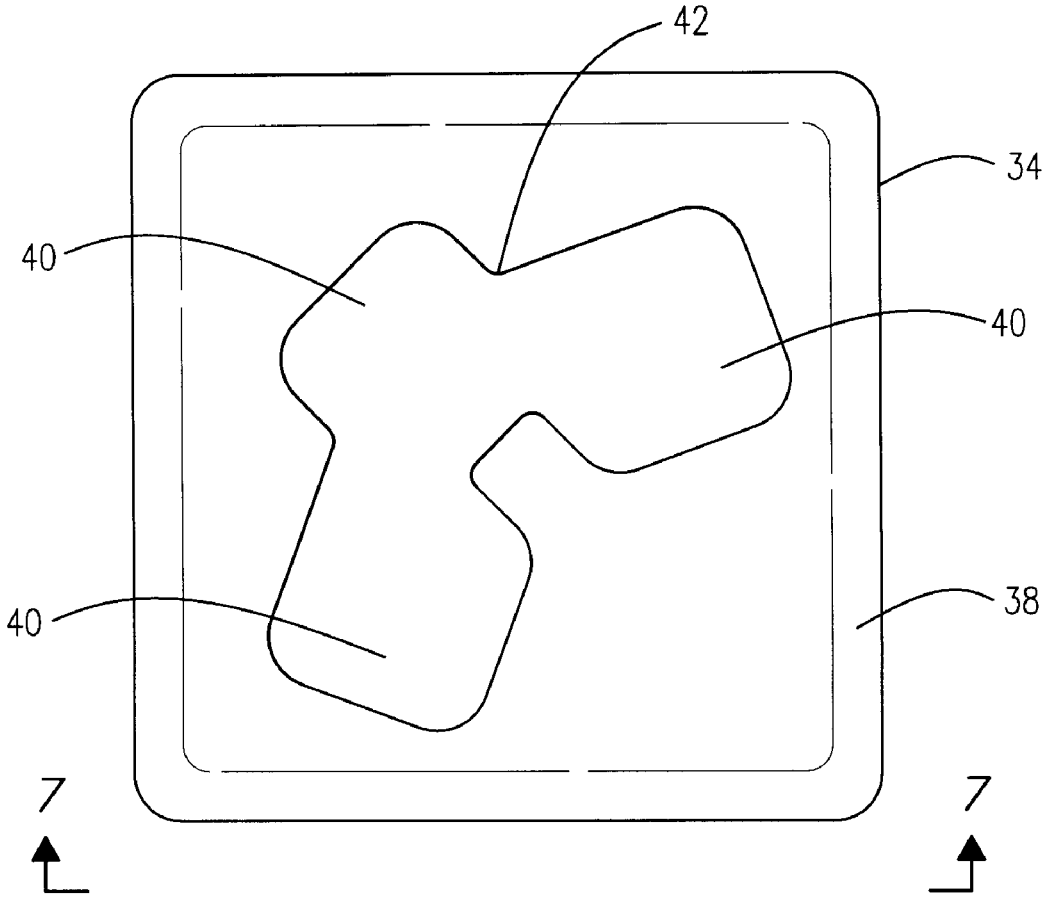
FIG. 6 is a top plan view of the closure member of the picket assembly of the present invention, with post pickets removed.
Figure 7:
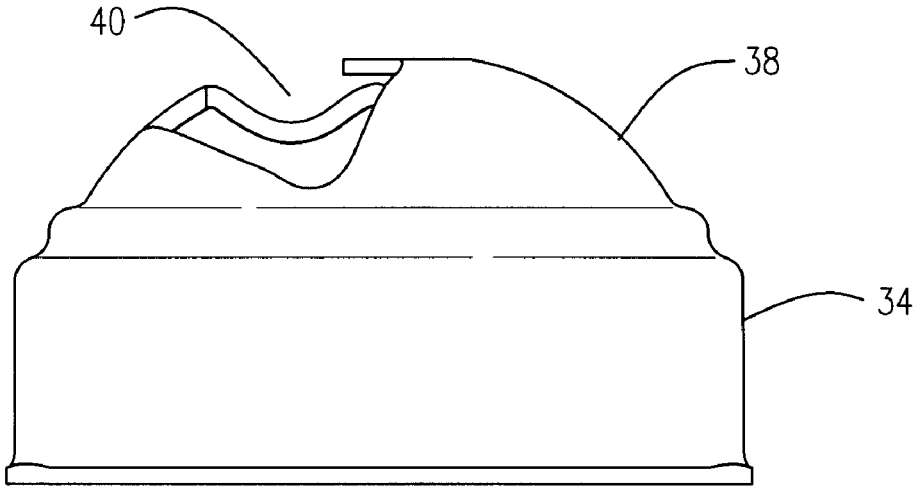
FIG. 7 is a side elevational view of the closure member shown in FIG. 6, taken along line 7-7.
Figure 8:
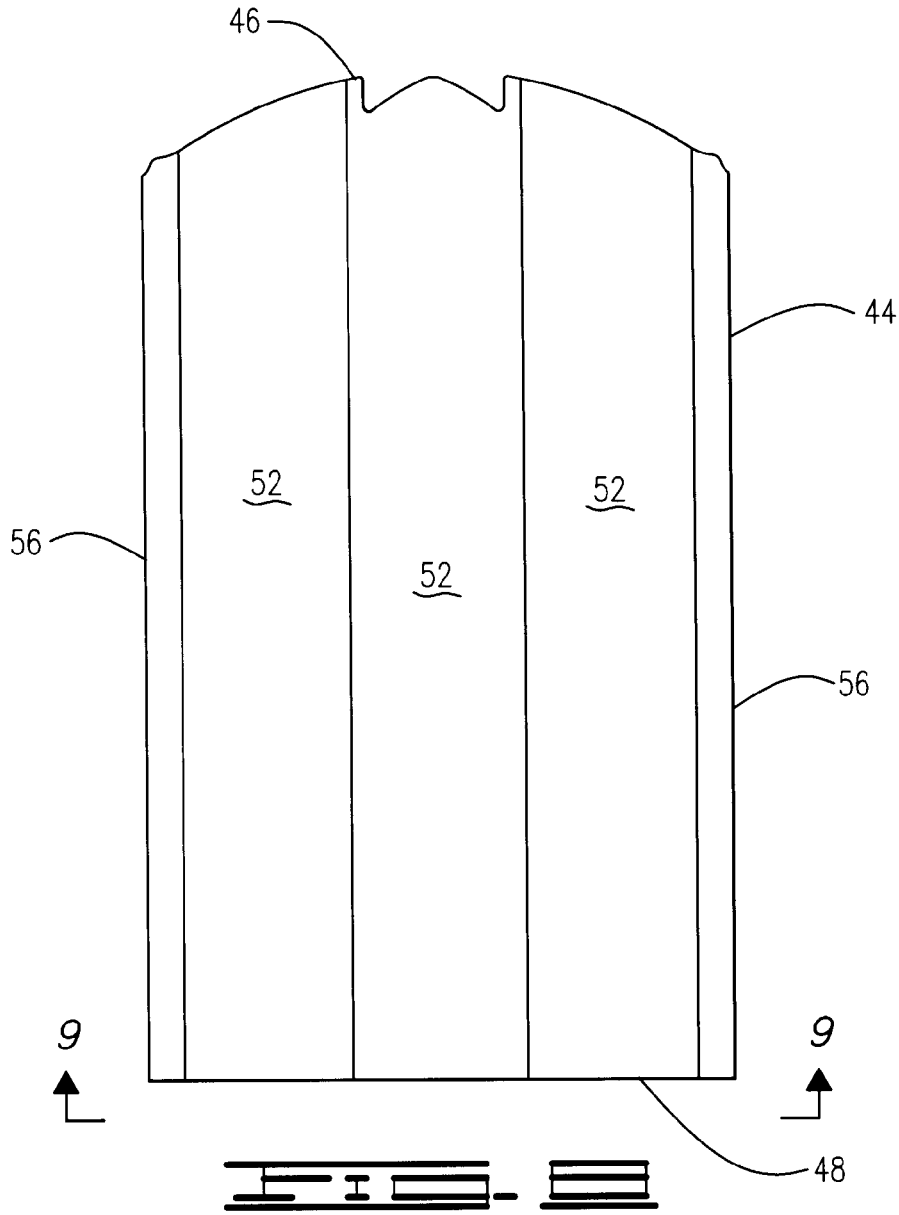
FIG. 8 is a top plan view of the bracket of the picket assembly of the present invention.

The recess or recesses 34 should be positioned so that the post picket or pickets 26, when installed in the cap 34, form an effective barrier within the region above corner post 12, with no disproportionately large gap existing between adjacent post pickets 26, or between a post picket 26 and its adjacent line picket 18. As best shown in FIGS. 2 and 6, the recesses 40 are arranged such that the installed post pickets 26 are disposed in a symmetrical arrangement, with substantially equal included angles between each adjacent pair of post pickets 66, and with the distance between the upper ends of each adjacent pair of post pickets 26 either equal or approximately equal.

As shown in FIGS. 3, 4, 5, 8 and 9, the post closure 32 further comprises a bracket 44 which extends from the lower surface 44 of cap 34. The bracket 44 is characterized by an upper end 46 and an opposed lower end 48, with an end-to-end length of between about 6 and about 12 inches. The upper end 46 of bracket 44 is shaped to conform to the contour of the inner surface 36 of cap 34, and is permanently secured to the inner surface 36 of cap 34, preferably by welding. Two welds 50 are shown in FIG. 5.

Figure 9:
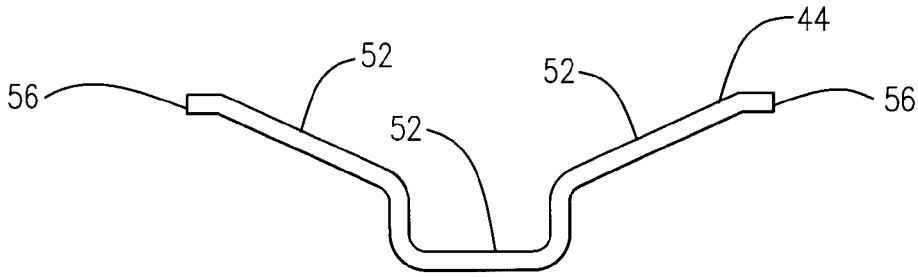
FIG. 9 is a side view of the bracket shown in FIG. 8, taken along line 9-9.

The bracket 44 is characterized by a transverse cross-sectional profile, best shown in FIGS. 5 and 9, that provides an attachment surface 52 that can bracingly engage the lower portion 30 of each post picket 26 when that post picket 26 is received through a recess 40 of the cap 34. The post picket 26 is secured to its attachment surface 52 on bracket 44, preferably by fasteners (not shown), such as tek screws. Alternative binding techniques, such as welding, may also be used. As shown in FIGS. 3 and 4, when the lower portion 30 of a post picket 26 is secured to bracket 44, its upper portion 28 extends uprightly from a position adjacent the outer surface 38 of cap 34.

As shown in FIG. 1, the bracket 44 should be sized so that it is clearingly receivable within the open upper end of the corner post 12. A gap 54 should exist between each side 56 of bracket 44, so that the tubular walls of corner post 42 may engage the inner surface 36 of cap 34 without obstruction. The bracket 44 should be positioned such that it traverses the cap 34 at an area of maximal width. Thus, if the base of cap 34 is characterized by a rectangular cross-section, the bracket 44 should extend along a diagonal thereof. If the base of cap 34 is characterized by a circular cross-section, the bracket 44 should extend along a diameter thereof.

The components of the picket assembly may be advantageously provided in the form of a kit, comprising a post closure, a sufficient number of post pickets to fill the recesses of the post closure cap and a sufficient number of fasteners to secure the post pickets to the post closure bracket. The fasteners should be provided in a number greater than or equal to the number of corner pickets. The kit further comprise the fasteners (if any) that are needed to secure the cap to a corner post.

Once assembled, the picket assembly 10 is installed by inserting bracket 44 into the upper end of corner post 12, and securing cap 34 to the corner post 12, with fasteners or otherwise. The installed picket assembly 10 serves to increase the security provided by barrier 14, by securely filling a gap that would otherwise exist in the area immediately above corner post 12. At the same time, the picket assembly 10 provides an aesthetically satisfying appearance that conforms to that presented by the line pickets 18 of the barrier 14.

While the present invention has been described with reference to a corner post, it should be understood that it may also be installed on a line post as well. In this eventuality, it may be preferable to use only a single post picket, and to position the recess and bracket of the post closure so that the post picket extends toward the exterior of the barrier.

Changes may be made in the construction, operation and arrangement of the various parts, elements, steps and procedures described herein without departing from the spirit and scope of the invention as defined in the following claims.

The invention claimed is:

1. A picket assembly adapted for installation on a post of a barrier, the post having an open upper end, comprising:

at least two post pickets, each post picket having an upper portion and a lower portion, the lower portion having a rectilinear profile; and a post closure, comprising:

a cap having outer and inner surfaces, the cap adapted to fit around the upper end of the post and having at least two recesses formed therein, the number of recesses equalling the number of post pickets, with each recess sized to clearingly receive the lower portion of a post picket therethrough; and a bracket extending from the inner surface of the cap, the bracket sized to be clearingly received within the open upper end of the post, the bracket providing an attachment surface adapted to bracingly engage the lower portion of each post picket when received through a recess of the cap.

2. The picket assembly of claim 1 in which the lower portion of each post picket is secured to the bracket.

3. The picket assembly of claim 1 in which the cap is characterized by a rectangular cross-sectional profile and in which the bracket is characterized as extending along a diagonal of the cap.

4. The picket assembly of claim 1 in which the recesses through which each post picket is extendable are joined.

5. The picket assembly of claim 4 in which the bracket transverses the cap at an area of maximal width.

6. The picket assembly of claim 1 in which the at least one post picket is characterized as comprising three post pickets.

7. The picket assembly of claim 6 in which the recesses through which each post picket is extendable are joined.

8. The picket assembly of claim 7 in which the bracket transverses the cap at an area of maximal width.

9. The picket assembly of claim 8 in which the upper portion of each post picket of the picket assembly is characterized by the same curved profile.

10. The picket assembly of claim 6 in which the upper portion of each post picket of the picket assembly is characterized by the same curved profile.

11. The picket assembly of claim 1 in which the upper portion of each post picket of the picket assembly is characterized by the same curved profile.

12. The picket assembly of claim 1 in which the bracket is characterized as having an upper end secured to the inner surface of the cap and a free and opposed lower end.

13. The picket assembly of claim 12 in which the lower end of each post picket extends beyond the lower end of the bracket.

14. The picket assembly of claim 1 in which the lower section of each post picket extends in flush and parallel relationship to a corresponding attachment surface of the bracket.

15. The picket assembly of claim 1 in which each post picket is characterized by an elongate lower portion.

16. The picket assembly of claim 15 in which each post picket is characterized by an upper portion having a curved profile.

17. A barrier comprising;

the picket assembly of claim 1, wherein the lower portion of each post picket is secured to the bracket; and a post upon which the picket assembly is installed.

18. The barrier of claim 17, further comprising:

a rail assembly comprising least two vertically spaced elongate rails, each rail supported at one end thereof by the post and extending in transverse relationship to the post; and a plurality of line pickets supported by the rail assembly, each line picket have an upper portion and a rectilinear lower portion.

19. The barrier of claim 18 in which the profile of the upper portion of each line picket conforms to that of the upper portion of each post picket of the picket assembly.

20. The barrier of claim 19 in which the upper portion of each post picket of the picket assembly is characterized by a curved profile.

21. The barrier of claim 19 in which the upper portion of each post picket of the picket assembly is characterized by a curved profile.

22. The barrier of claim 19 in which the post is a corner post.

23. The barrier of claim 18 in which the length of the lower portions of the post pickets is less than the length of the lower portions of the line pickets.

24. A kit, comprising:

at least two post pickets, each post picket having an upper portion and a lower portion, the lower portion having a rectilinear profile; and a post closure, comprising:

a cap having outer and inner surfaces, the cap adapted to fit around the upper end of a post having an open upper end and having at least two recesses formed therein, the number of recesses equalling the number of post pickets, with each recess sized to clearingly receive the lower portion of a post picket therethrough; and a bracket extending from the inner surface of the cap, the bracket sized to be clearingly received within the open upper end of a post, the bracket having one or more attachment surfaces adapted to bracingly engage the lower portion of each post picket when received through a recess of the cap.

25. The kit of claim 24, further comprising:

at least one fastener adapted to secure the lower portion of each picket to an attachment surface of the bracket, the fasteners provided in a number greater than or equal to the number of post pickets.

26. The kit of claim 14 in which the bracket is characterized as having an upper end secured to the inner surface of the cap and a free and opposed lower end.

27. The kit of claim 26 in which the lower end of each post picket is extendable beyond the lower end of the bracket, when received through a recess of the cap.

28. The kit of claim 24 in which the lower section of each post picket is extendable in flush and parallel relationship to a corresponding attachment surface of the bracket, when received through a recess of the cap.

29. The kit of claim 24 in which each post picket is characterized by an elongate lower portion.

30. The kit of claim 29 in which each post picket is characterized by an upper portion having a curved profile.

* * * * *